United States Patent [19]

Sakamoto et al.

[11] Patent Number: 4,991,102

[45] Date of Patent: Feb. 5, 1991

[54] ENGINE CONTROL SYSTEM USING LEARNING CONTROL

[75] Inventors: Masahide Sakamoto; Takeshi Atago; Junichi Ishii, all of Katsuta; Matsuo Amano, Hitachi; Nobuo Kurihara, Hitachiota, all of Japan

[73] Assignee: Hitachi, Ltd., Tokyo, Japan

[21] Appl. No.: 215,815

[22] Filed: Jul. 6, 1988

[30] Foreign Application Priority Data

Jul. 9, 1987 [JP] Japan ..... 62-171378
Jul. 20, 1987 [JP] Japan ..... 62-180668

[51] Int. Cl.[5] ..... F02M 51/00; F02B 3/04; F02D 41/26

[52] U.S. Cl. ..... 364/431.06; 123/480; 364/431.05

[58] Field of Search ..... 364/431.05, 431.06, 364/431.03, 442; 123/480, 486, 489

[56] References Cited

U.S. PATENT DOCUMENTS

| | | | |
|---|---|---|---|
| 4,130,095 | 12/1978 | Bowler et al. | 60/285 |
| 4,363,097 | 12/1982 | Amano et al. | 364/431.06 |
| 4,442,815 | 4/1984 | Ninomiya | 364/431.05 |
| 4,458,319 | 7/1984 | Chujo et al. | 364/431.05 |
| 4,491,921 | 1/1985 | Sugiyama et al. | 364/431.05 |
| 4,535,736 | 8/1985 | Taura et al. | 364/431.05 |
| 4,566.068 | 1/1986 | Iwasaki et al. | 364/431.05 |
| 4,671,235 | 6/1987 | Haraka | 123/399 |
| 4,703,430 | 10/1987 | Amano et al. | 364/431.05 |
| 4,733,357 | 3/1988 | Abe | 364/431.05 |
| 4,737,914 | 4/1988 | Abe et al. | 364/431.05 |

FOREIGN PATENT DOCUMENTS 60-65254 4/1985 Japan .

OTHER PUBLICATIONS

Grimm et al: GM Microcomputer Engine Control System, Technical Paper #800053 of the Society of Automotive Engineers, Inc., Feb. 1980.

*Primary Examiner*—Felix D. Gruber
*Attorney, Agent, or Firm*—Antonelli, Terry, Stout & Kraus

[57] ABSTRACT

An engine control system is disclosed in which the air-fuel ratio is controlled by feedback in accordance with the oxygen concentration detected of the exhaust gas, and a feedback control system thereof separate learning compensation values for compensating for the changes of the input/output characteristics of an air flow meter and a fuel injector respectively. The engine control system comprises a device for detecting the engine intake air flow, a device for detecting the engine speed, a device for detecting the oxygen concentration of the exhaust gas, a device for calculating the error between actual and target air-fuel ratios from the oxygen concentration of the exhaust gas, a device for learning the changes in the input/output characteristics of the intake air flow, a detection device to determine a first compensation factor corresponding to the changes in the input/output characteristics thereof, a device for learning the changes in the input/output characteristics of the fuel injection device to determine a second compensation factor corresponding to the changes in the input/output characteristics thereof, a device for calculating a basic fuel injection amount from the first compensation factor, the engine speed and the intake air amount, a device for calculating a required fuel flow rate reducing the air-fuel ratio error from the basic fuel injection amount, the second compensation factor and the air-fuel ratio error, a device for generating a drive signal indicating the required fuel flow rate, and the device for injecting fuel into the intake air path in the engine in response to the drive signal indicating the required fuel flow rate.

20 Claims, 11 Drawing Sheets

ENGINE CONTROL SYSTEM USING LEARNING CONTROL

BACKGROUND OF THE INVENTION

The present invention relates to a control system for automobile engines, or more in particular to a gasoline engine control system using learning control for determining the fuel flow rate in the feed-back control of air-fuel ratio.

Automotive gasoline engines developed recently are equipped with a control system including a microcomputer for controlling the operating conditions thereby to reduce the harmful components in the exhaust gas and improve fuel economy. In fact, an electronic engine control system operates in such a way that in response to signals from various sensors representing engine operating conditions, various factors including fuel supply rate and ignition timing are controlled thereby to attain the optimum engine operating conditions.

An example of an electronic engine control system is disclosed in JP-A-55-134721 filed for Japanese patent by Hitachi Ltd on Apr. 6, 1979 and its corresponding U.S. Pat. No. 4,363,097 issued on Dec. 7, 1982.

In the typical electronic engine control system of this type, the fuel flow rate is controlled by an air-fuel feedback method. According to such a method, the intake air flow detected by an air flow sensor and the engine speed are used to determine a basic fuel injection rate. This basic fuel injection rate is multiplied by an air-fuel ratio feedback factor making up a feedback value corresponding to the oxygen concentration in the exhaust gas and other compensation factors representing control parameters. A battery voltage compensation is added to the resulting compensated basic fuel injection rate thereby to determine a required fuel injection rate. By a drive signal corresponding to the required fuel injection rate thus calculated, the opening time of an injector nozzle is controlled to maintain the air-fuel mixture at a target air-fuel ratio (stoichiometric air-fuel ratio).

The required fuel injection rate is thus represented by the pulse width of the drive signal applied to the injector The pulse width $T_P$ of the drive signal corresponding to the basic fuel injection rate that is the basic fuel injection pulse width and the pulse width Ti corresponding to the required fuel injection rate (hereinafter referred to as "the required injection pulse width") are given as $$T_P = k \times Q_a / N \ldots \quad (1)$$

$$Ti = T_P \times K \times \alpha \times K_L + T_S \ldots \quad (2)$$

where k is a constant, $Q_a$ an intake air amount, N an engine speed, K a compensation factor due to the engine cooling water temperature, etc., $\alpha$ a compensation factor for the air-fuel ratio feedback, $K_L$ a learning compensation value of fuel flow rate, and $T_S$ an ineffective pulse width of injector (battery voltage compensation).

Specifically, by use of the intake air flow rate $Q_A$ of the engine and the engine speed N, the basic fuel injection time $T_P$ is determined from equation (1). The resulting value of the basic fuel injection time $T_P$ is multiplied by the air-fuel ratio feedback compensation factor $\alpha$ thereby to determine a fuel injection flow rate associated with a target air-fuel ratio (stoichiometric air-fuel ratio). In the fuel flow rate control system of an actual engine, the input-output characteristics of the various actuators (such as a fuel injector) and sensors (such as an air flow sensor) are subjected to secular and other variations. To control the fuel flow rate only with the feedback compensation factor o is not sufficient but secular and other variations are required to be compensated by learning thereby to secure accurate air-fuel ratio control. The compensation thus achieved by learning is provided as a learning compensation value $K_L$.

The learning compensation value $K_L$ will be explained in more detail. An $O_2$ sensor disposed in the exhaust pipe produces a binary signal (high-level voltage for rich and low-level voltage for lean mixture) in accordance with the oxygen concentration (lean for high and rich for low oxygen concentration) in the exhaust gas. This binary signal is used to increase or decrease the air-fuel ratio feedback factor $\alpha$ stepwise, followed by gradual increase or decrease respectively to approach a target air-fuel ratio. FIG. 1 shows the conditions of the air-fuel ratio feedback factor $\alpha$ which undergoes a change upon detection of a rich- or lean-side value of the air-fuel ratio in response to the output signal $\lambda$ of the oxygen sensor.

With regard to the air-fuel ratio feedback factor $\alpha$ with the oxygen sensor signal reversed in direction, the local maximum value in the process of change from lean to rich state is assumed to be $\alpha_{max}$, and that in the process of change from rich to lean state to be $\alpha_{min}$. The average value of the two $\alpha_{ave}$ is given as $$\alpha_{ave} = (\alpha_{max} + \alpha_{min})/2 \ldots \quad (3)$$

The deviation between the average value $\alpha_{ave}$ shown in equation (3) and unity is defined as a learning compensation value $K_L$. In other words, $$K_L = \alpha_{ave} - 1 \ldots \quad (4)$$

If the air-fuel ratio feedback factor $\alpha$ is 1, it is the same as if the air-fuel ratio has attained a target value without air-fuel feedback control by the oxygen sensor.

The learning compensation value $K_L$ varies from one engine operating region to another, and therefore a memory has stored therein a learning compensation value for writing the learning compensation value $K_L$ for each operating region indicated by the engine speed and the basic fuel injection rate (pulse width) shown in FIG. 2. In an operating region subjected to air-fuel ratio feedback control, the calculation of equation (4) is performed with the $K_L$ value written for the particular region on the map. Further, in order to compensate for the secular variations of the fuel flow rate control system, each value of $K_L$ in the map is learned and updated during the operating period. At the time of calculation of the required fuel injection rate, the memory is read to use the learning compensation value $K_L$ of an associated operating region. The learning compensation value $K_L$ is learned, that is, updated at a time when the engine operating region remains unchanged while a predetermined number of local maximum values of the air-fuel ratio compensation factor $\alpha$ occur in succession, that is, when the operating condition is not transient. The map of FIG. 2 is divided into a total of 64 operating regions. In general operation of a car, it is a rare thing to use all the regions on the map. The learning compensation value $K_L$ for an unlearned or unexperienced operating region is calculated by estimation from the learning compensation values $K_L$ for the regions surrounding the particular operating region.

The learning control of the air-fuel ratio is disclosed, for example, in JP-A-60-65254 filed for patent in Japan by Hitachi Ltd. on Sept. 20, 1983 and JP-A-60-111034 field for patent in Japan by Hitachi Ltd. on Nov. 21, 1983 and the U.S. Pat. No. 4,703,430 issued on Oct. 27, 1987, and claiming the priority right based thereon.

The conventional learning control systems are for compensating for variations in input/output characteristics or secular variations of all sensors and actuators of a fuel injection control system only by means of a single learning compensation value $K_L$. Further, as seen from equation (1), the basic fuel injection rate $T_P$ is not compensated at all. The air flow rate sensor of an air flow sensor such as a hot-wire sensor for detecting the intake air flow $Q_a$, however, has an input/output characteristic thereof which is sometimes subjected to variations in the course of production or initial input/output characteristics thereof sometimes undergoing variations due to dust or oily contamination attached thereto in the course of operation. As a result, the value of the intake air flow $Q_a$ detected has some error. If the intake air flow $Q_a$ has an error, the basic fuel injection rate $T_P$ naturally develops an error. The basic fuel injection rate $T_P$ corresponds to an engine load, on the basis of which the optimum ignition timing is determined, and therefore an error in the intake air amount of the air flow meter would lead to an improper ignition timing, resulting in a reduction in engine performance or fuel efficiency or a case of knocking.

Changes in input/output characteristics due to secular variations, on the other hand, are not limited to the air flow meter, but occur also in the fuel injector. The injector nozzle, in particular, is liable to be reduced in diameter by dust in the fuel or carbon due to backfire deposited thereon to reduce the fuel flow rate. The secular variations of the fuel injector thus cause an error in fuel injection rate, thereby greatly affecting the control of the air-fuel ratio.

In view of these facts, if an accurate air-fuel ratio and an accurate ignition timing are to be attained in the learning control of the fuel injection rate, it is necessary to compensate separately for the variations in input-/output characters of the air flow meter and the fuel injector.

SUMMARY OF THE INVENTION

In view of the above-mentioned problem of learning control of fuel flow rate in conventional systems, the object of the present invention is to provide an engine control system capable of accurate air-fuel ratio control and ignition timing control with a learning compensation factor provided to compensate for the variations in the input/output characteristics of an air flow meter and a fuel injector separately.

In order to achieve the above-mentioned object, there is provided according to the present invention, an engine control system comprising means such as an air flowmeter for detecting the intake air flow of an engine, means for detecting the speed of the engine, means such as an oxygen sensor for detecting the oxygen concentration in the exhaust gas, means for calculating the error between actual air-fuel ratio and a target air-fuel ratio in accordance with the oxygen concentration of the exhaust gas, means for learning variations of the input-/output characteristics of the intake air amount detection means and determining a first compensation factor in accordance with the variations of the input/output characteristics, means for learning the variations of the input/output characteristics of fuel injection means and determining a second compensation factor in accordance with the variations of the input/output characteristics, means for calculating a basic fuel injection rate from the first compensation factor, the engine speed and the intake air flow, means for calculating a required fuel flow rate to reduce the error of the air-fuel ratio from the basic fuel injection rate, the second compensation factor and the error of the air-fuel ratio, means for generating a drive signal indicating the required fuel flow rate, and means such as a fuel injector for injecting fuel into the intake path in the engine in response to a drive signal indicating the required fuel flowrate.

According to one aspect of the present invention, an error between the first and second learning compensation factors is determined by dividing the air-fuel ratio error in a predetermined ratio, with the predetermined ratio being changeable in accordance with the intake air flow.

According to another aspect of the invention, the first and second learning compensation factors are calculated in different regions of intake air flow respectively.

According to still another aspect of the present invention, the first and second learning compensation factors are calculated when the engine has been used a predetermined number of times.

DESCRIPTION OF THE PREFERRED EMBODIMENTS

Figure 3:
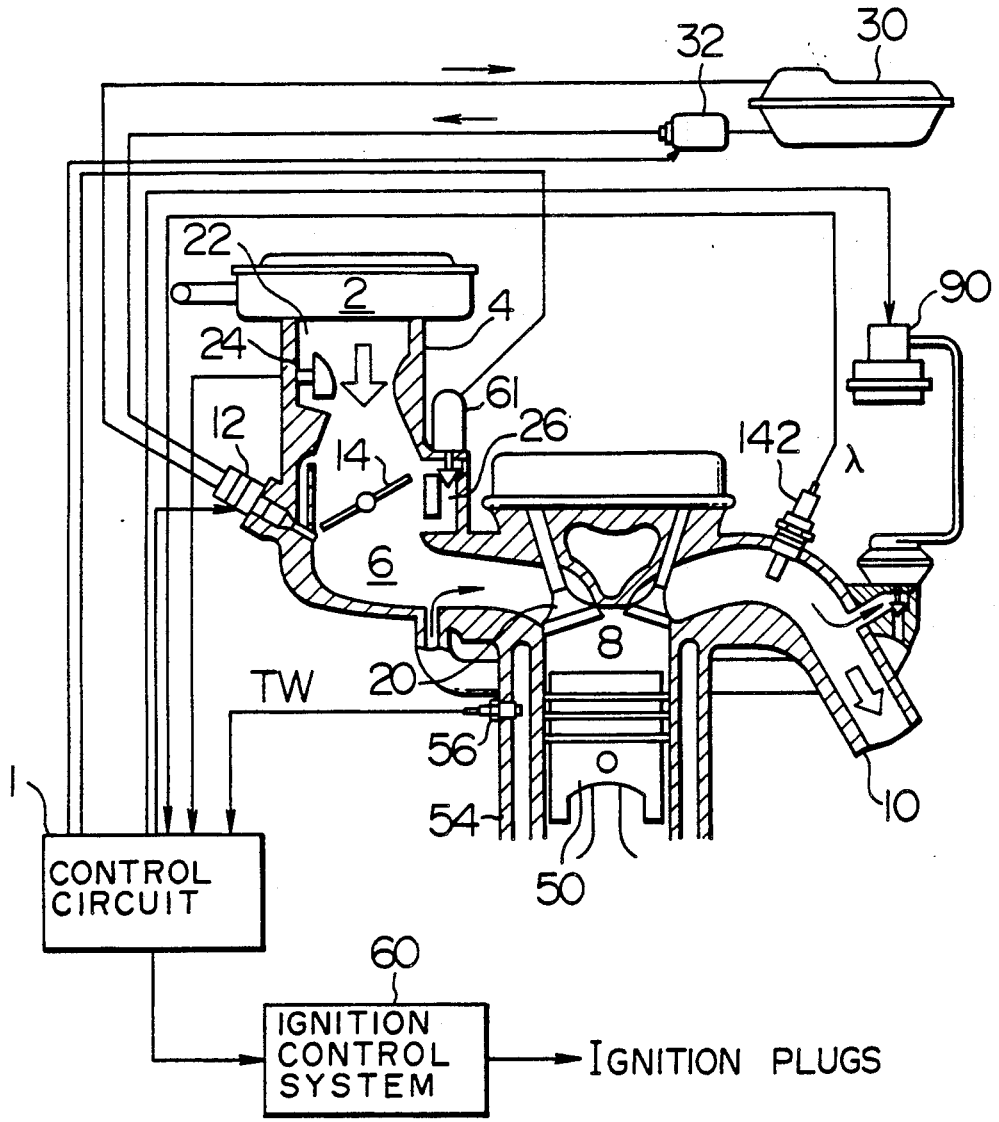
FIG. 3 is a diagram showing a general configuration of an engine control system to which the present invention is applicable.

FIG. 3 is a schematic diagram showing the whole system configuration to which an engine control system according to the present invention is applied. Intake air is supplied into a cylinder 8 through an air cleaner 2, a throttle chamber 4 and an intake manifold 6. The exhaust gas from a cylinder 8 is discharged through an exhaust pipe 10 into the atmosphere.

The throttle chamber 4 includes an injector 12 for injecting fuel. The fuel injected from the injector 12 is atomized in the air path of the throttle chamber 4, and mixed with the intake air to form a gas mixture. The mixture is supplied through the intake manifold 6 into the combustion chamber of the cylinder 8 with the opening of the intake valve 20.

A throttle valve 14 is disposed in the vicinity of the outlet of the injector 12. The throttle valve 14 is so constructed as to change the opening degree in accordance with the motion of an acceleration pedal.

In addition to a main air path, an auxiliary air path 22 is arranged upstream of the throttle valve 14 of the throttle chamber 4. The auxiliary air path 22 is provided with an air flow rate sensor, that is, a hot wire 24 for producing an electrical signal AF changing with the air flow velocity, which electrical signal AF is applied to the control circuit 1 for calculating the intake air flow $Q_a$. The flow rate sensor 24 made up of a hot wire is mounted within the auxiliary air path 22, and therefore is protected against the high temperature gas due to backfire and also against contamination with dust or the like in the intake air. The outlet of this auxiliary air path 22 is opened in the vicinity of the narrowest portion of the venturi and the inlet thereof to the upstream side of the venturi.

The injector 12 is kept supplied with fuel under pressure from a fuel tank 30 through a fuel pump 32. When a drive signal from the control circuit 1 is applied to the injector 12, the nozzle opens for the period of the pulse width of the drive signal so that fuel is injected from the injector 12 into the intake manifold 6.

The air and gas mixture introduced from the air intake valve 20 is compressed by a piston 50, and combusted by a spark from an ignition plug (not shown). The thermal energy of this combustion is converted into kinetic energy The cylinder 8 is cooled by cooling water 54. The temperature of this cooling water is measured by a water temperature sensor 56, and applied to the control circuit 1 as a parameter for determining the fuel injection rate or the ignition timing.

The junction of the exhaust manifold 10 is provided with an oxygen sensor 142 for detecting the oxygen concentration of the exhaust gas. The oxygen concentration λ thus detected is applied to the control circuit 1.

The crankshaft (not shown) of the engine carries thereon a crank angle sensor for generating a reference angle signal for each reference crank angle in accordance with the engine speed and a position signal for each predetermined angle (such as 0.5 degree). A signal from the crank angle sensor is applied to the control circuit 1 in order to generate a signal for measuring the engine speed or determining the ignition timing. The control circuit 1 includes a microcomputer and a memory and controls the engine in accordance with a control program. The control circuit 1 is connected with an ignition control system. The ignition control system is well known and operates to generate a high voltage to start a spark in the ignition plug in accordance with a signal indicating the optimum ignition timing calculated by the control circuit 1.

Further, the throttle chamber 4 is provided with an air bypass 26 connected to the intake manifold 6 beyond the throttle valve 14. The bypass 26 includes a bypass valve 61 subjected to open/close control.

The bypass valve 61, which faces the bypass 26 circumventing the throttle valve 14, is operatively controlled by a pulse signal from the control circuit 1, and according to the amount of lift thereof, changes the sectional area of the bypass 26.

An EGR (Exhaust Gas Recirculation) control valve 90 is for controlling the amount of EGR from the exhaust manifold 10 to the intake manifold 6.

According to the control system shown in FIG. 3, as described above, the injector 12 is controlled to control the increase or decrease of both the air-fuel ratio and the fuel flow, while at the same time controlling the idle engine speed by the bypass valve 61 and the injector 12. Further, it is capable of controlling the EGR rate.

Figure 4:
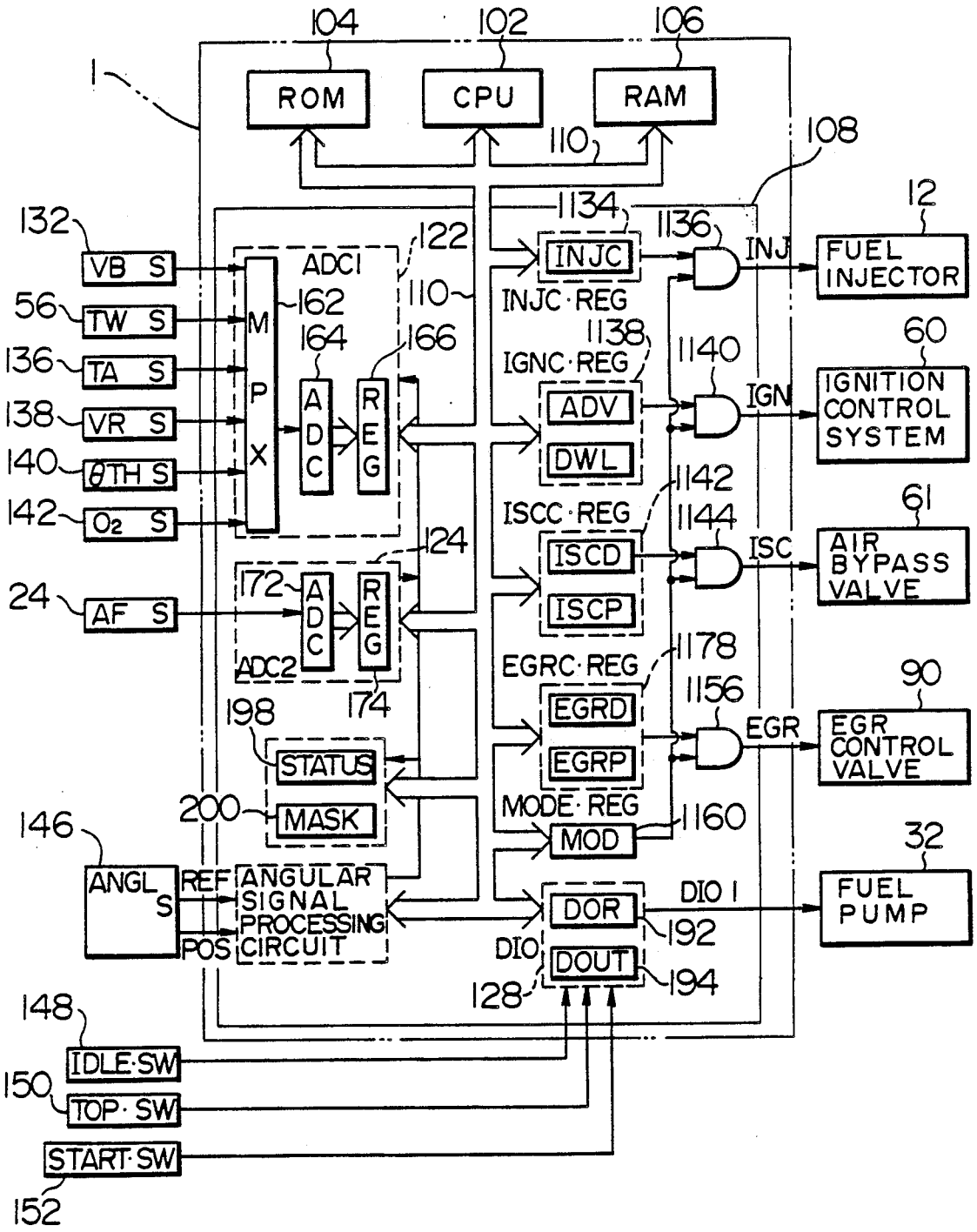
FIG. 4 is a block diagram showing a control circuit of an engine control system and surrounding circuits thereof according to the present invention.

FIG. 4 shows a general configuration of the control circuit 1 using a microcomputer. Various sensors and actuators not included in FIG. 3 are shown in FIG. 4. The control circuit 1 includes a central processing unit (hereinafter referred to as "the CPU") 102, a read-only memory (hereinafter referred to as "the ROM") 104, a random access memory (hereinafter referred to as "the RAM") 106, and an input/output circuit 108. The CPU 102 operates to perform calculations based on the input data from the input/output circuit 108 and the control program stored in the ROM 104 and provides the result of calculation back to the input/output circuit 108 as a control output. The RAM 106 is used for the temporary data storage required in the course of these calculation processes Data exchange between the CPU 102, ROM 104, RAM 106 and input/output circuit 108 is effected by a bus line 110 including a data bus, a control bus and an address bus.

The input/output circuit 108 includes a first analog-digital converter 122 (hereinafter referred to as "ADC1"), a second analog-digital converter 124 (hereinafter referred to as "ADC2"), an angular signal processing means 126 and a discrete input/output circuit 128 (hereinafter referred to as "DIO") for input and output of 1-bit data.

The ADC1 has a multiplexer 162 (hereinafter referred to as "MPX") supplied with outputs from a battery voltage detection sensor 132 (hereinafter referred to as "VBS") and an oxygen sensor 142 (hereinafter referred to as "A/FS"). From the MPX 162, one of the inputs is selected and applied to an analog-digital converter circuit 164 (hereinafter referred to as "ADC"). The digital amount that is an output of the ADC 164 is set in a register 166 (hereinafter referred to as "REG").

An angle sensor 164 (hereinafter referred to as "ANGLS") produces a signal (hereinafter referred to as "REF") indicating a reference crank angle, say, 180° (for four-cylinder engine) and a position signal (hereinafter referred to as "POS") indicating the crank angle of, say, 0.5 degree. Both of these signals are applied to an angular signal processing circuit 126 in which the waveforms thereof are shaped.

The DIO 128 is supplied with outputs from an idle switch (hereinafter referred to as "IDLE-SW") 148 for indicating the idle state when the throttle valve 14 returns to full-closed position, a top gear switch (hereinafter referred to as "TOP-SW") 150 for indicating that the transmission is in top gear position, and a starter switch (hereinafter referred to as "START-SW") for indicating the actuation of a starter.

Now, a pulse output circuit and an object of control based on the result of calculation of the CPU 12 will be explained. An injector control circuit (hereinafter referred to as "INJC") 1134 operates to convert the digital value representing the result of calculation into a pulse output. A drive pulse signal INJ having a pulse width corresponding to the required fuel injection rate $T_i$ calculated by learning control is generated by the INJC 1134 and applied through an AND gate 1136 to the injector 12.

An ignition pulse generation circuit (hereinafter referred to as "IGNC") 1138 includes a register (hereinafter referred to as "ADV") for setting an ignition timing and a register (hereinafter referred to as "DWL") for setting a conduction start time of the primary current of the ignition coil. These data values are set in the register from the CPU 102. The IGNC 1138 generates an ignition pulse signal IGN on the basis of the data thus set. The ignition pulse signal IGN is applied through an AND gate 1140 to an ignition control system 611.

The opening degree of the bypass valve 61 is controlled by a pulse signal ISC applied thereto from a control circuit (hereinafter referred to as "ISCC") 1142 through an AND gate 1144. The ISCC 1142 includes a register ISCD for setting a pulse width and a register ISCP for setting a pulse period.

An EGR rate control pulse generation circuit (hereinafter referred to as "FEGRC") 1178 for controlling the EGR control valve 90 includes a register EGRD for setting a value indicating the duty factor of the pulse and a register EGRP for setting a value indicating a pulse period. An output pulse EGR of this EGRC is applied through an AND gate 1156 to the control valve 90.

A one-bit input/output signal, on the other hand, is controlled by the circuit DIO 128. Input signals include an IDLE-SW signal, a START-SW signal and a TOP-SW signal. An output signal, on the other hand, includes a signal for driving the fuel pump. This DIO includes a register DOR 192 for determining whether an input signal from each switch should be received and a register DOUT 194 for latching the output data.

A mode register (hereinafter referred to as "MOD") 1160 is for holding instructions for ordering various states in the input/output circuit 108. By setting an instruction in this mode register 1160, all the AND gates 1136, 1140, 1144 and 1156 may be turned on or off. In this way, the MOD register 1160 may be set with an instruction to control the stop and start of the outputs of the INJC, IGNC and ISCC.

The DIO 128 produces a signal DIO1 for controlling the fuel pump 32.

With this electronic engine control system, it is thus possible to control substantially all aspects of an internal combustion engine including the air-fuel ratio properly to such an extent where the emission control regulation imposed on automobiles is sufficiently cleared.

Now, explanation will be made about a method of controlling the fuel injection rate by setting a learning compensation value separately for the air flow meter and the fuel injector.

In a first embodiment of the present invention, the basic fuel injection rate $T_P$ and the required fuel injection rate $T_i$ are defined by the following equations:

$$T_P = k \cdot Q_a \cdot K_{L1} / N \ldots \quad (5)$$

$$T_i = T_P \cdot K \cdot \alpha \cdot K_{L2} + T_S \ldots \quad (6)$$

where $K_{L1}$ is a learning compensation value for compensating the detection error of the fuel flow rate caused by the change in the input/output characteristics of the air flow meter, and $K_{L2}$ is a learning compensation value for compensating the detection error of the fuel flow rate caused by the change in the input/output characteristics of the fuel injector. Other reference numerals and characters designate quantities identical to those designated respectively in equations (1) to (4) above.

Figure 5:
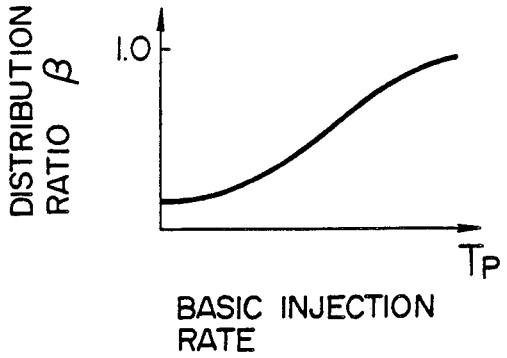
FIG. 5 is a diagram showing a characteristic of distribution ratio of the learning compensation value according to an embodiment of the present invention
Figure 6:
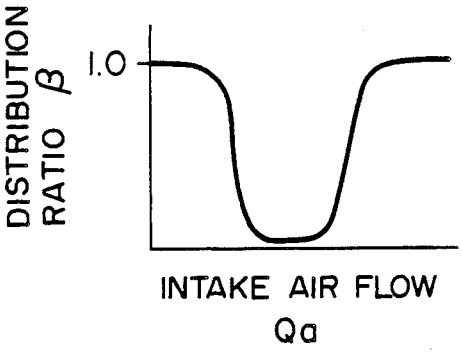
FIG. 6 is a diagram showing another characteristic of distribution ratio of the learning compensation value.
Figure 8:
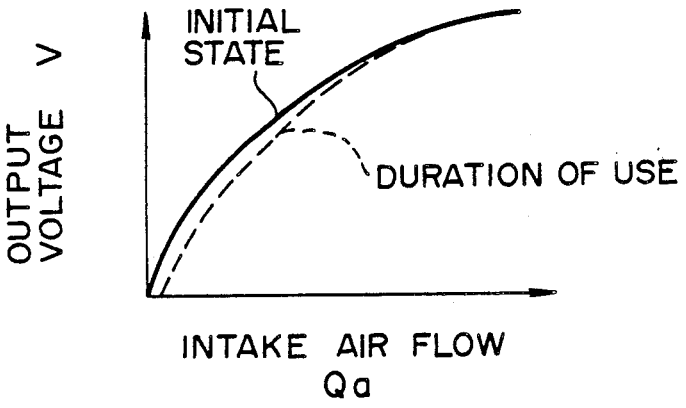
FIG. 8 is a diagram showing secular variations of the input/output characteristics of an air flow sensor.
Figure 9:
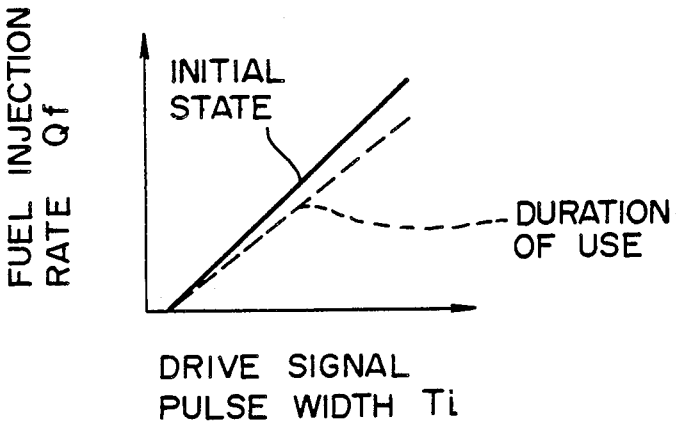
FIG. 9 is a diagram showing secular variations of the input/output characteristics of a fuel injector.

Now, explanation will be made about the trend of change in the input/output characteristics of the injector 12 and the air flow sensor 24. In the case of the injector 12, as shown in FIG. 9, the gradient representing the relationship between the required fuel injection rate (pulse width) $T_i$ and the flow rate of fuel actually injected $Q_f$ undergoes a change from point a to point b in the course of operation over a long period of time. In the case of the air flow sensor 24, on the other hand, as shown in FIG. 8, the relationship between the actual air flow $Q_a$ and the output voltage of the sensor 24 tends to shift by a predetermined amount This indicates that in the low-load region with small intake air amount, the characteristic change of the air flow sensor 24 has a greater effect on the detection error of the fuel flow rate than that of the injector 12, while in the high-load region with large intake air amount, the reverse is the case. Taking note of this fact, it has been determined that the learning compensation value $K_L(=\alpha_{ave}-1)$ can be obtained from equation (1). Value $K_L$ is separated proportionately into two values by applying the ratio $\beta$ to $K_L$ to obtain learning compensation values $KL_1$ and $KL_2$. The learning compensation value $K_{L1}$ is for the air flow sensor and the learning compensation value $K_{L2}$ is for the injector respectively. The ratio $\beta$ is dependent on the basic fuel flow $T_p$ which is obtained by equation (1) and corresponds to the amount of load of the engine. This ratio $\beta$ is changed along the characteristic curve shown in FIG. 5 in accordance with the basic fuel injection rate $T_P$ of equation (1) corresponding to the load or along the characteristic curve of FIG. 6 in accordance with the intake air amount $Q_a$. The characteristics of FIGS. 5 and 6 are determined experimentally in advance and stored in the form of a map in the ROM 104. The values $\delta_1$ and $\delta_2$ are obtained by proportionately separating the learning compensation value $K_L$ (the deviation from a target air-fuel ratio) using the ratio $\beta$ and are thus defined as shown in the equations below.

$$\delta_2 = (\alpha_{ave} - 1) \times \beta \ldots \quad (7)$$

$$\delta_2=(\alpha_{ave}-1)-\alpha_1 \ldots \quad (8)$$

The first and second learning compensation values $K_{L1}$ and $K_{L2}$ are updated by learning. Specifically, the first and second compensation values $K_{L1}$ and $K_{L2}$ are updated replacing the present values by the equations shown below and stored in the map shown in FIG. 7.

$$K_{L1}(NEW)=K_{L1}(PRESENT)+\delta_1\times\gamma_1 \ldots \quad (9)$$

$$K_{L2}(NEW)=K_{L2}(PRESENT)+\delta_2\times\gamma_2 \ldots \quad (10)$$

where $\gamma_1$, $\gamma_2$ are weight factors.

In initial stage of engine operation, where neither the first learning compensation value $K_{L1}$ nor the second learning compensation value $K_{L2}$ is yet learned, $K_{L1}=\delta_1\times\gamma_1$ and $K_{L2}=\delta_2\times\gamma_2$. The weight factors are multiplied because if the learning compensation values are updated at once, a hunting or an overshoot would occur and it takes time before the air-fuel ratio is restored to a target value, thereby making a smooth control impossible. The weight factors $\gamma_1$, $\gamma_2$ are determined at optimum values by experiments. In the case where the basic fuel injection rate $T_P$ and the required fuel injection rate $T_i$ are calculated from equations (5) and (6), the first learning compensation value $K_{L1}$ associated with the air flow meter and the second learning compensation value $K_{L2}$ associated with the injector are read out of the learning value map of FIG. 7 respectively. In the learning compensation value map, the first learning compensation value $K_{L1}$ associated with the air flow meter is filled separately in each of a plurality of regions into which the intake air flow $Q_a$ is divided. This is by reason of the fact that the output characteristic of the air flow meter of hot wire type takes a form of the fourth-power function curve as shown in FIG. 8, so that the change rate of the output with secular variations depends on the intake air flow regions. As for the second learning compensation value $K_{L2}$ associated with the injector, a single value is set regardless of different intake air flow. This is because the input/output characteristics of the injector are linear and the change rate of the input/output characteristics of the injector with secular variations thereof are fixed in all fuel injection regions as shown in FIG. 9. Depending on the type of the injector or air flow meter, however, the characteristics shown in FIGS. 8 and 9 are not necessarily obtained. In accordance with the characteristics of the injector or air flow meter, therefore, the map of the learning compensation factors may be configured in the manner shown in FIG. 10.

Figure 11:
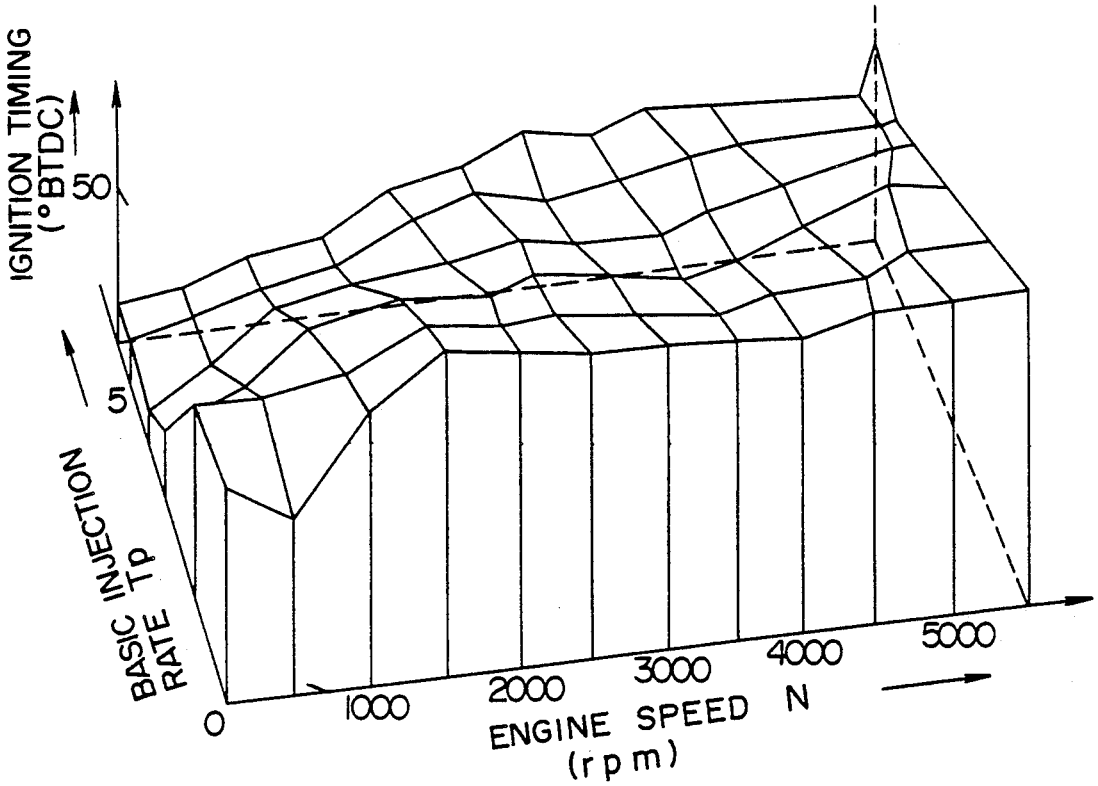
FIG. 11 shows an example of an ignition timing map.

As will be seen from equation (5), the new basic injection pulse width $T_P$ includes a first learning value $K_{L1}$, and therefore is corrected to a proper value sequentially in accordance with the characteristic change (FIG. 8) of the air flow sensor 24, thus making it possible to search the ignition timing map correctly. An example of the ignition timing map is shown in FIG. 11. The optimum ignition timing is determined from the basic fuel injection rate $T_P$ and the engine speed N.

On the other hand, as seen from equation (6), the required fuel injection pulse width $T_i$ includes a second learning value $K_{L1}$, corresponding to the characteristics change (FIG. 9) of the injector 12 based on the basic injection pulse width $T_P$ subjected to learning compensation with $K_{L1}$, and therefore a correct value thereof may be obtained in accordance with the present characteristics of the injector 12.

There are various systems for detecting the intake air flow for the air flow meter, including a system for detection from the intake manifold pressure and engine speed and a system for detection from the throttle opening angle and engine speed. This invention is applicable to any of these systems with the same effect as in the aforementioned embodiments.

Figure 12:
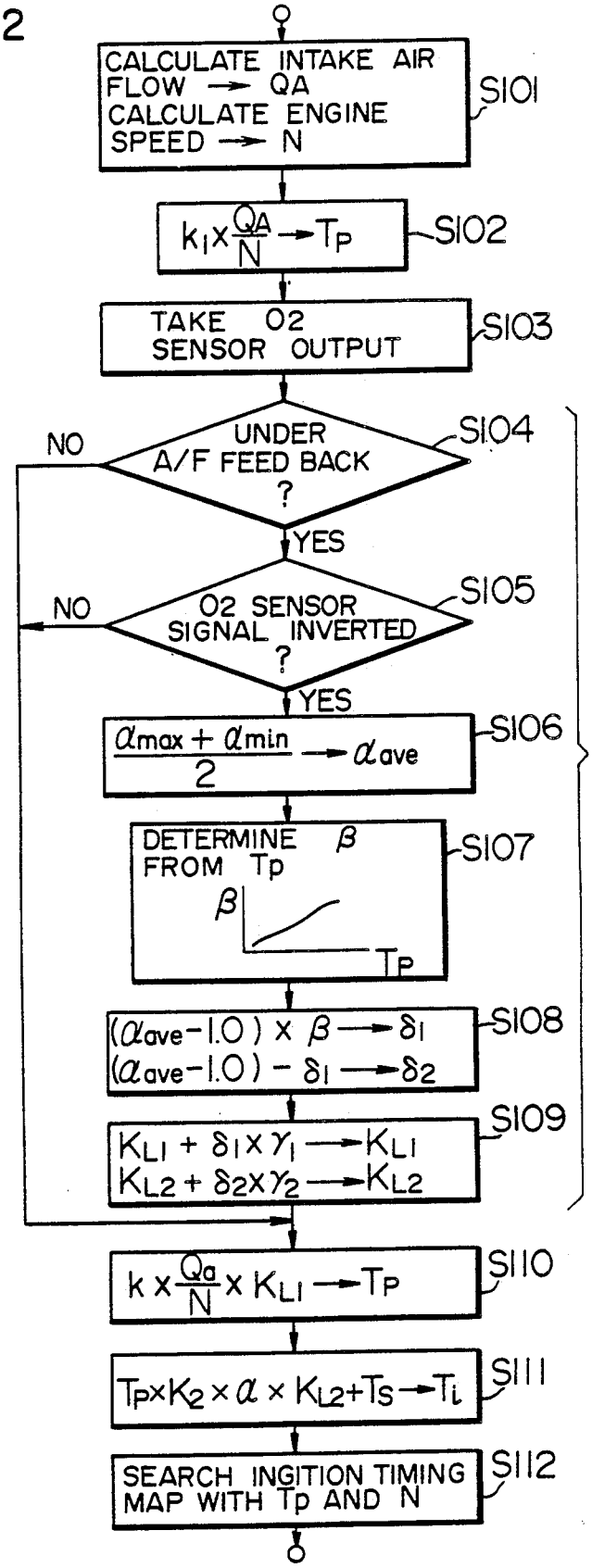
FIG. 12 is a flowchart of a learning program for the learning compensation values according to an embodiment of the present invention.

The engine control using the two learning compensation values $K_{L1}$ and $K_{L2}$ described above is executed according to a program stored in the ROM 104 of the microcomputer 1. The flowchart of this program is shown in FIG. 12. Each step of this flowchart will be explained below. In the flow of FIG. 12, steps S101 to S103 may be considered a preprocessing, flow steps S104 to S102 a learning processing flow, step S110 a flow for calculation of a new basic fuel injection pulse width $T_P$, step S111 a flow for calculating a new required fuel injection pulse width $T_i$ and step S112 a flow for searching the ignition timing map.

First, step S101 calculates the intake air flow $Q_a$ on the basis of an angular signal from an air flow rate signal from the air flow sensor 24 and an angular signal from the angle sensor 146 thereby to determine the engine speed N.

Figure 1:
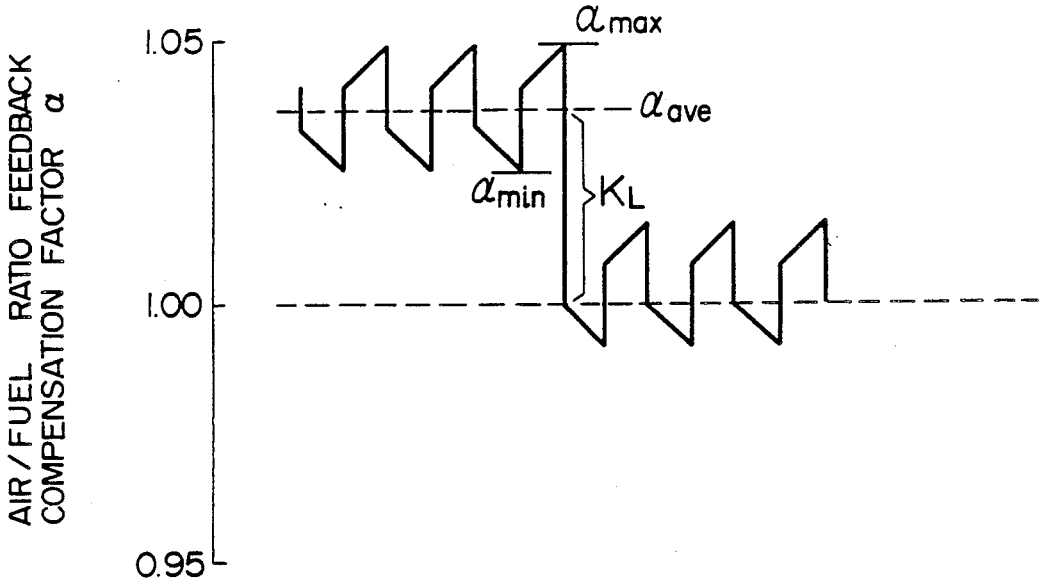
FIG. 1 is a diagram showing an example of the change in air-fuel ratio feedback compensation factor depending on the air-fuel ratio control.

Then, the basic injection pulse width $T_P$ is calculated at step S102 from the intake air flow $Q_a$, the engine speed N and a constant k according to the equation (1). The constant k is stored in the ROM 104 previously Step S103 collects an output signal of the oxygen sensor 5. Step S104 decides whether the air-fuel ratio is under feedback control based on various sensed parameters of the engine. If the air-fuel ratio is not under feedback control, that is, the answer at step S104 is "No", there is no need of learning. Therefore, the process jumps to step S110, so that steps S110 to S112 effects normal injection control and ignition timing control. In the case where the air-fuel ratio is under feedback control that is, when the answer at step S104 is "Yes", the amount of feedback is required to be reflected in the control amount of the fuel flow rate for learning, and therefore the process proceeds to step S105. Step S105 decides whether the output signal of the oxygen sensor 142 has been inverted (See FIG. 1). This decision is a prerequisite for the calculation at the next step S106. If the result of decision is "No" that is, if the output signal of the oxygen sensor 142 has not been inverted, then learning is impossible, so that the process jumps to steps S110 to S112 for normal injection control and ignition timing control. If the inversion is confirmed at step S105, that is, the answer at step S105 is "Yes", the process proceeds to the next step S106.

Step S106 is for calculating an average value $\alpha_{ave}$ of the maximum value $\alpha_{max}$ and minimum value $\alpha_{min}$ of the oxygen feedback amount.

Step S107 determines the relations held in FIG. 5 or FIG. 6 the ratio $\beta$ of separation of the learning value taking the characteristics change of the air flow sensor 24 into consideration in accordance with the basic injection pulse width $T_P$ determined at step S102. $T_P$ is a value corresponding to the engine load.

Step S108 is for determining a first distribution factor $\delta_1$ from equation (7) in consideration of the distribution ratio $\beta$ determined above, followed by the calculation of a second factor $\delta_2$ from equation (8) in consideration of the first factor $\delta_1$. As a result of this calculation, the error of the actual air-fuel ratio from a target air-fuel ratio (that is, $\alpha_{ave}-1.0$) is distributed in a ratio corresponding to the intake air flow $Q_a$ and the injector characteristics.

Figure 7:
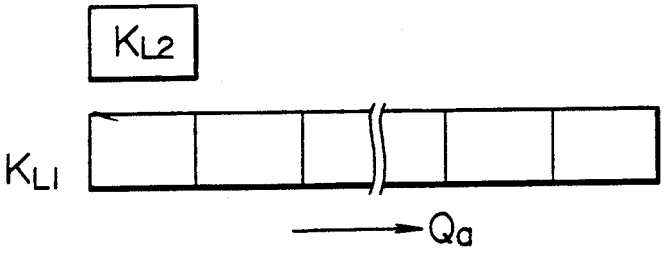
FIG. 7 is a diagram showing an example of a map storing two learning compensation values
Figure 10:
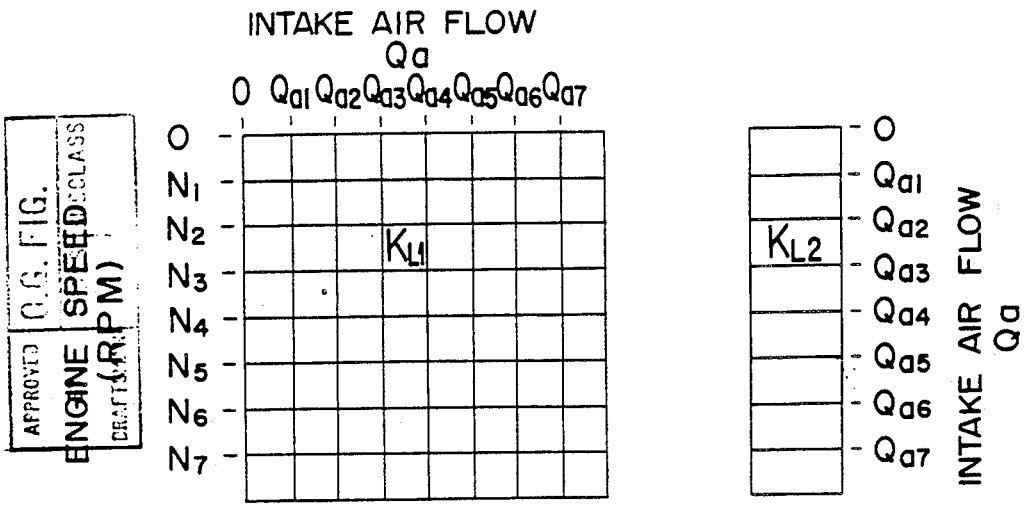
FIG. 10 shows another example of the map for storing two learning compensation values

Step S109 is such that the first and second distribution factors $\delta_1$, $\delta_2$ and the weight factors $\gamma_1$, $\gamma_2$ are reflected in the preceding first and second learning values $K_{L1}$, $K_{L2}$ thereby to update the learning compensation value map of FIG. 7 or 10.

Step S110 is such that the first learning value $K_{L1}$ associated with the air flow sensor 24 is reflected in the basic injection pulse width calculated at step S102 thereby to prepare a new basic injection pulse width $T_P$.

Step S111 prepares a new required injection pulse width $T_i$ by use of the second learning value $K_{L2}$ associated with the injector 12 on the basis of the new injection pulse width $T_P$, thus updating the learning compensation value map of FIG. 7 or FIG. 10. Subsequently until the next learning, the injector 12 is controlled by this required injection pulse width $T_i$.

Step S112 searches the ignition timing map of FIG. 11 by using the new basic injection pulse width $T_P$ and the engine speed N, and thus attains a correct ignition timing as controlled by the ignition timing control system 60.

Now, explanation will be made about a second embodiment of the invention for determining learning compensation values for the air flow meter and the injector by another method. This embodiment utilizes the fact that there is not substantially any change in input/output characteristics over a long time of operation in a specific air flow rate region depending on the type of the hot wire sensor.

Figure 13:
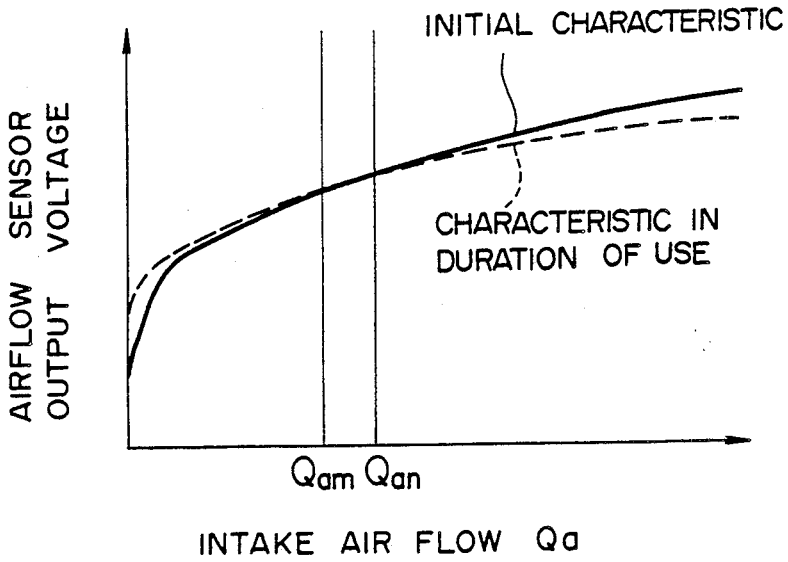
FIG. 13 is a diagram showing another example of the secular variations of the input/output characteristics of the air flow sensor.

Secular variations of the injector are shown in FIG. 9. A hot wire sensor shown in FIG. 8 undergoes a secular variation in low and middle air flow rate regions but not substantially in the high flow rate region. In the case of FIG. 13, on the other hand, characteristics remain almost unchanged in middle flow rate regions within the range of $Q_{am}$ to $Q_{an}$ in intake air flow rate.

According to the second embodiment, the properties of the air flow sensor is utilized to determine the learning compensation value of the injector characteristics of FIG. 9 in an intake air flow rate region where the input/output characteristics of the air flow sensor remains unchanged and also to determine the learning compensation value of the characteristics of the air flow sensor in other intake air flow rate regions. In this way the first and second learning compensation values are determined independently.

In the second embodiment, the basic fuel injection rate $T_P$ and the required fuel injection rate $T_i$ are defined by the equations shown below.

$$T_P = k \times Q_a \times K_H / N \ldots \quad (11)$$

$$T_i = T_P \times K \times \alpha \times K_L \times K_I + T \ldots \quad (12)$$

where $K_H$ is a learning compensation value for the air flow meter, $K_I$ a learning compensation value for the injector, and other symbols have the same meanings as those used in equations (1) to (10) respectively.

The hardware and the circuit configuration of the second embodiment are basically identical to those shown in FIGS. 3 and 4 for the first embodiment, except for the control program stored in the ROM 104.

Figure 14:
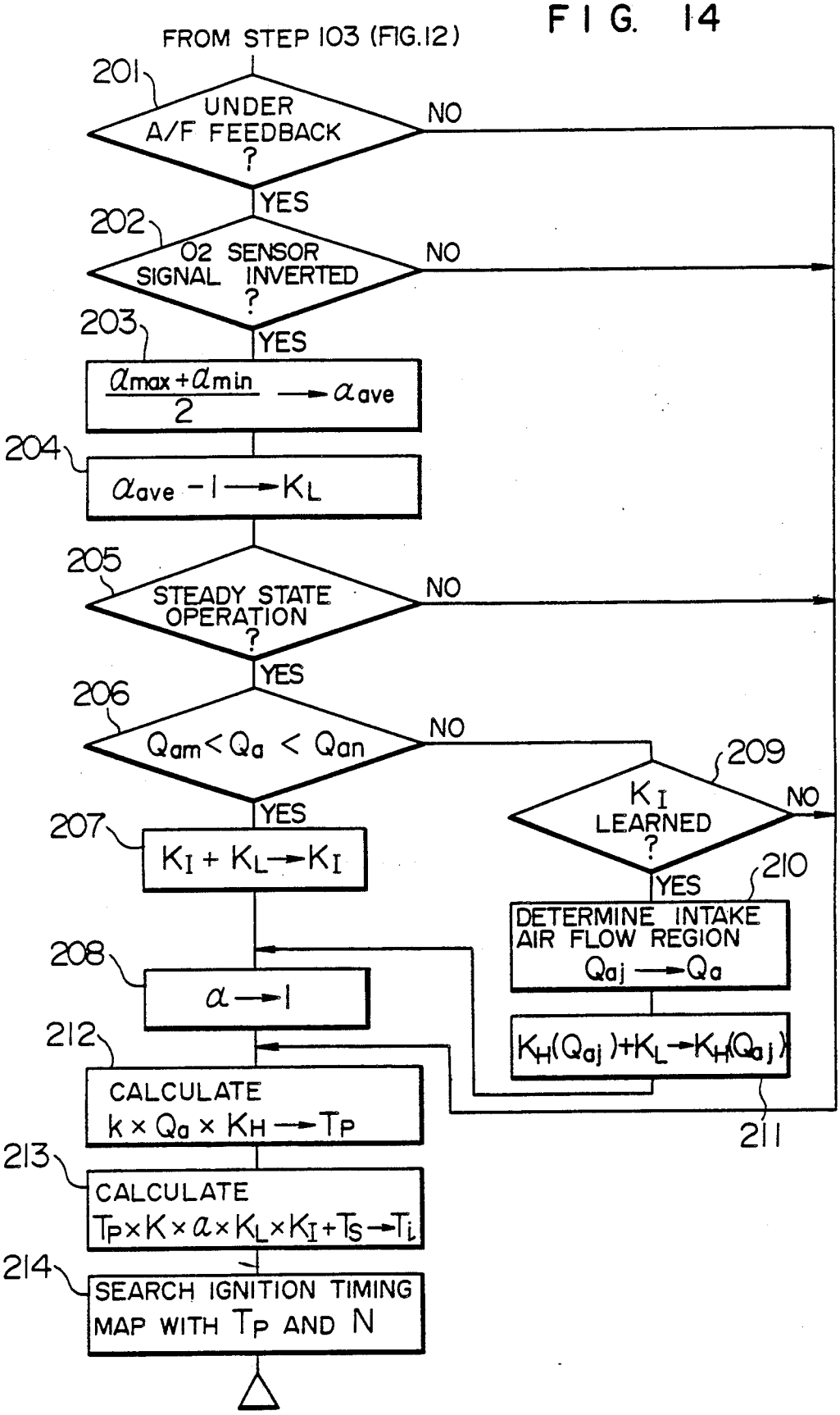
FIG. 14 is a flowchart showing a learning program for the learning compensation values according to an embodiment of the present invention.

A flowchart of a control program for the second embodiment is shown in FIG. 14. In the flowchart of FIG. 14, the steps preceding to step 201 are identical to steps 101 to 103 in the flowchart of the first embodiment shown in FIG. 12 are therefore are neither shown in the drawing nor explained any more. The flowchart of FIG. 14 shows a case in which the air flow sensor undergoes substantially no secular variations in the middle flow rate region $Q_{am}$ to $Q_{an}$ as shown in FIG. 13.

Figure 2:
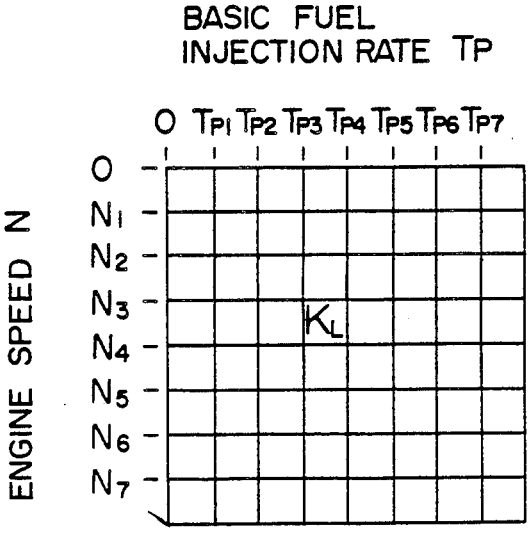
FIG. 2 shows a map for storing the learning control compensation value $K_L$.

Step 201 decides whether the air-fuel ratio is under feedback control with an oxygen sensor. If the air-fuel ratio is not under feedback control, the learning processing is not effected but the process jumps to step 212 for calculating the basic fuel injection rate $T_P$ and the required fuel injection rate $T_i$ by use of the current learning compensation values $K_H$, $K_L$. If step 201 decides that the air-fuel ratio is under feedback control, step 202 decides whether the output signal of the oxygen sensor has been inverted (See FIG. 1). If it is not inverted, the process jumps to step 212. If step 202 decides that the output signal of the oxygen sensor has been inverted, on the other hand, step 203 calculates the average value $\alpha_{ave}$ of the air-fuel ratio feedback amount $\alpha$. Step 204 calculates an error $K_L$ of the air-fuel ratio target value from the average value $\alpha_{ave}$. The error value is stored in the learning value map shown in FIG. 2. Step 205 decides that the engine is not in transient state. The decision that the engine is in steady state is made from whether the engine operating region does not undergo a change beyond a predetermined width and the local maximum values of the air-fuel ratio compensation factor $\alpha$ has occurred a predetermined number of times in succession. If it is decided that the engine is not in steady state, the process jumps to step 212. If the engine is found in steady state, step 206 decides whether the intake air flow rate $Q_a$ is in the middle flow rate region between $Q_{am}$ and $Q_{an}$. If the answer at step 206 is "Yes", step 207 updates the learning compensation value $K_I$ of the injector. A new learning compensation value $K_I$(NEW) of the injector is obtained by adding the error $K_L$ to the present learning compensation value $K_I$(PRESENT). Specifically, $$K_I(NEW) = K_I(PRESENT) + K_L \ldots \quad (13)$$

The present learning compensation value $K_I$ (PRESENT) is updated to the new learning compensation value $K_I$(NEW) by the learning compensation value map of FIG. 7. In the initial engine state, no learning is experienced as yet on $K_I$, and therefore $K_I$(NEW)$=K_L$. If the learning on $K_L$ has not yet been conducted, calculation is made by estimation from $K_L$ in other regions or an appropriate value is set in initial setting of the control program and progressively updated to a correct value by learning. Subsequently, step 208 replaces the air-fuel ratio feedback factor $\alpha$ with unity.

In the case where step 206 decides that the intake air flow rate is not in a predetermined region, step 209 decides whether the learning compensation factor $K_I$ for the injector has been learned already. If not, the process jumps to step 212 for working on the learning compensation value for the injector first. If $K_I$ has been learned already, step 210 decides on the position of an intake air flow rate region from the map of the learning compensation value $K_H$ for the air flow sensor shown in FIG. 15, and thus reads out the value of the present learning compensation value $K_H$ for that particular region $Q_{aj}$. The new learning compensation value $K_I$(NEW) for the air flow meter in the intake air flow rate region $Q_{aj}$ is obtained by adding the error $K_L$ to the present learning compensation value $K_I$(PRESENT) in $Q_{aj}$. Specifically, $$K_I(NEW)=K_I(PRESENT)+K_L \cdots \quad (14)$$

Figure 15:
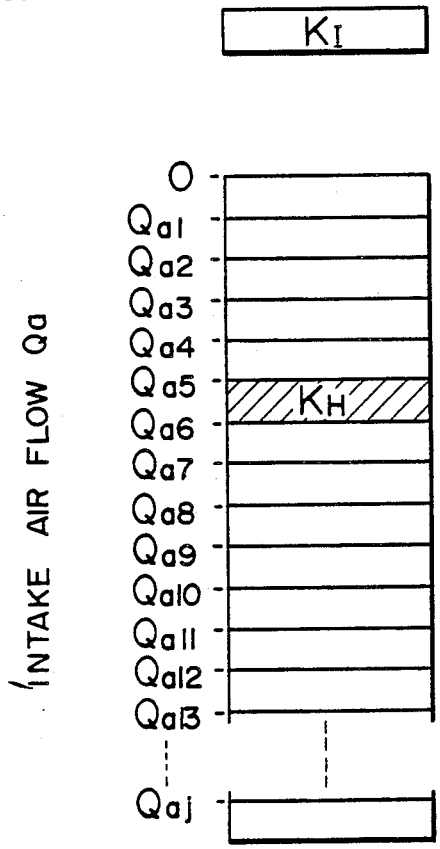
FIG. 15 is a diagram showing an example of a map for storing two learning compensation values

The present learning compensation value is updated to a new one by the map of FIG. 15. In the initial engine state, no learning has yet been conducted on $K_H$, and therefore $K_H(NEW)=K_L$. If $K_L$ is not yet learned, calculation is made by estimation from $K_L$ of other regions or an appropriate value is set in initial settings of the control program and progressively updated to a correct value by learning Step 208 thus updates the air-fuel ratio feedback factor $\alpha$ to unity. In the map of FIG. 15, a single region is assigned for the learning compensation value $K_I$ for the injector and a plurality of regions for the intake air amount in the learning map for the air flow sensor. Instead of this map, a map such as shown in FIG. 10 may be formed depending on the characteristics of the injector and the sensor. In the case where the map of the learning compensation value $K_I$ of the injector is divided into a plurality of regions, a region deciding step is inserted between steps 206 and 207.

The basic fuel injection rate $T_P$ is then calculated by equation (11) in step 212. Step 213 calculates the required fuel injection rate from equation (12). Step 214 reads the optimum ignition timing for the engine speed N and the basic fuel injection rate $T_P$ out of the ignition timing map of FIG. 11. A drive signal of a pulse width corresponding to the required fuel injection rate $T_I$ thus determined is generated in an injector control circuit 1134 (FIG. 4) thereby to open the injector 12. On the other hand, an ignition pulse signal IGN is prepared from the basic fuel injection rate $T_P$ at an ignition pulse generation circuit 1138 (FIG. 4), and in accordance with this signal, a high-voltage ignition pulse is generated by the ignition control system 60 to be applied to the ignition plug.

The second embodiment described above refers to the case in which the characteristics of the air flow sensor remains unchanged in the middle flow rate region of the intake air. The same principle, however, is easily applicable with equal effect to the case where the characteristics remain unchanged in the high air flow rate region as shown in FIG. 8 by changing the conditions for decision at step 206. The second embodiment is thus applicable for any regions free of secular variations of the air flow sensor.

A third embodiment of the present invention will now be explained. According to this embodiment, the separate learning for the air flow meter (air flow sensor) and the fuel injector described above are effected at a timing when the engine performance becomes stable, that is, when the accumulated distance coverage of a vehicle, if such air flow meter or the injector is mounted thereon, reaches about 1,000 km, and in the preceding initial operating period, the conventional learning is effected only for the learning compensation value $K_L$ of equation (2) alone. By doing so, a learning compensation value map shown in FIG. 2 that fully meets the engine variations due to production processes or environmental variations thereof is capable of being prepared, thereby making possible accurate error compensation of the fuel flow rate in the subsequent separate learnings on the two learning compensation values.

According to this third embodiment, there is provided means for detecting an accumulated number of times (time period) of the engine operation, or in the case of an automobile engine, the accumulated distance coverage for effecting separate learning when the predetermined number of operations or the accumulated distance coverage is exceeded. Even after the initial operating period, compensation for the secular variations of the device characteristics other than for the air flow meter and injector can be accomplished by the learning of the learning compensation value $K_L$ at predetermined time intervals.

Figure 16:
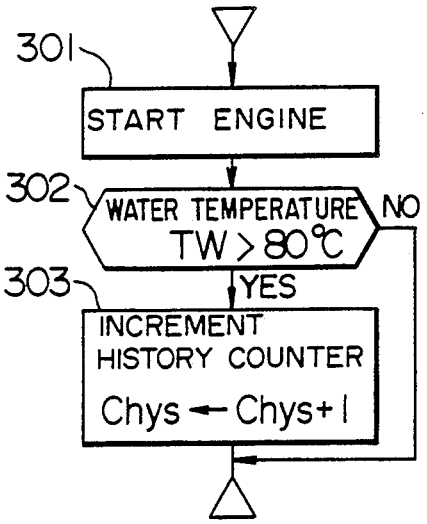
FIG. 16 is a flowchart of a counter program for accumulating the number of times of engine operation

FIG. 16 is a flowchart of a program for counting an accumulated number of times of engine operations. Step 301 detects that the engine has started by an output of a starter switch 152. Step 302 decides whether the signal from the water temperature sensor 56 indicates that the water temperature TW has exceeded 80° C. The water temperature of 80° C. taken up here as one example is a value indicating that the engine has been warmed up, and somewhat varies with the engine or vehicle types. If the decision at step 302 is "No", it indicates that the engine has not been used, and the process waits for the next start. If step 302 decides that the water temperature is higher than 80° C., the count Chys of the history counter is incremented by one. This value of Chys is set to zero before shipment of a new engine Instead of following the flow of FIG. 16, the distance coverage of the vehicle may be accumulated.

Figure 17:
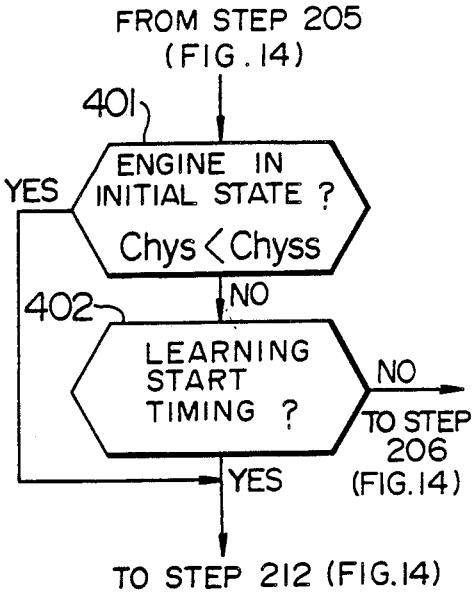
FIG. 17 shows a part of the flowchart of the learning program for the learning compensation value according to an embodiment of the present invention.
Figure 18:
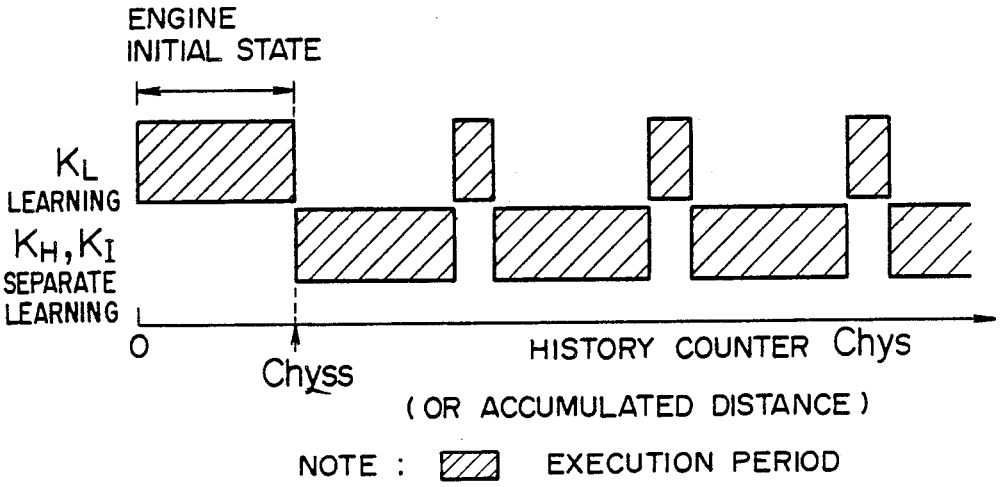
FIG. 18 is a time chart for processing along the flowchart of FIG. 17.

FIG. 17 is a diagram showing the essential parts of the flowchart of a processing program according to the third embodiment. The flow of FIG. 17 is inserted between steps 205, 206 and 212 in the flowchart of FIG. 14. The same steps as those in FIG. 14 will not be described any more. Step 401 decides whether the count Chys of the history counter has exceeded the value Chys representing the last point of the initial operating period set in advance. If the initial operating point is passed, or the answer is "Yes", the process proceeds to step 212 in FIG. 14. If step 401 decides that the initial operating period is involved, step 402 decides whether the timing of learning the learning compensation value $K_L$ is involved. In the process, as shown in the time chart of FIG. 18, the count Chys of the history counter is checked to conduct alternate learnings of the learning compensation value $K_L$ alone and the separate learning of $K_H$ and $K_I$ at predetermined intervals. If it is decided that the timing of learning of $K_L$ is involved, or the answer is "Yes", the process proceeds to step 212. If the decision is that the $K_L$ learning timing is not involved (separate learning of $K_H$ and $K_I$), the process is passed to step 206 to execute the separate learnings.

Figure 19:
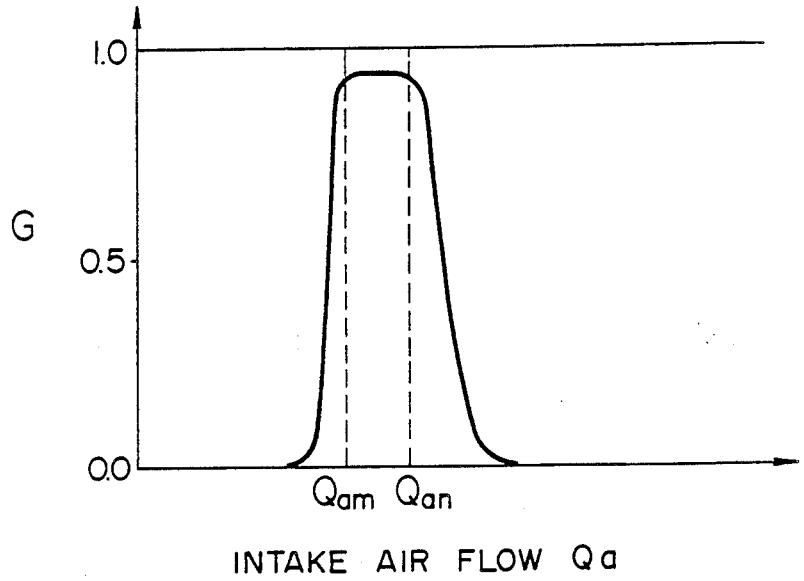
FIG. 19 shows a characteristic of the distribution factor of the separate learning of the learning compensation value.

Now, a fourth embodiment of the present invention will be explained. The second embodiment, as described above, utilizes the secular variations of the air flow sensor characteristics shown in FIG. 6. In the second embodiment, the variations of injector characteristics in the middle air flow rate region $Q_{am}$ to $Q_{an}$ is regarded as substantially zero in learning the learning compensation value of the air flow sensor, and the effect of the air flow in other air flow rate sensor regions is regarded as substantially zero in conducting the learning on the injector. In actual engines, however, the characteristics of the air flow sensor undergo some changes even in the middle air flow rate region or the region itself may change. In the adjacent regions outside of $Q_{an}$ and $Q_{am}$, on the other hand, the injector characteristics undergo some changes. The proportion G of the effect that the air flow sensor and the injector have on the air-fuel ratio error is set as shown in FIG. 19. In FIG. 19 the G value is 0.95 in the flow rate range from to $Q_{an}$ $Q_{am}$ indicating that the injector has a strong effect on the air-fuel ratio error, with the G value smoothly changed in the regions before and after that particular range. The learning compensation values $K_H$ and $K_I$ of the air flow meter and the injector are defined by the following equations:

$$K_I(NEW)=K_I(PRESENT)+K_L\cdot G... \quad (15)$$

$$K_H(NEW)=K_H(PRESENT)+K_L\cdot(1-G)... \quad (16)$$

where G and $K_H$ are values varied with the intake air flow $Q_a$, and the characteristic diagram of G may be stored in memory in the form of a map.

Figure 20:
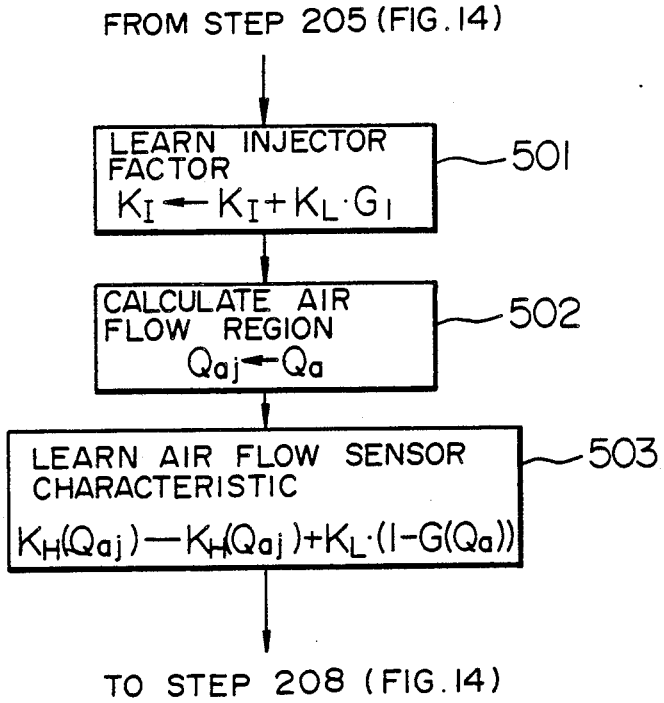
FIG. 20 shows a part of the flow chart of the learning program utilizing the characteristic of FIG. 19.

FIG. 20 is a flowchart for a program for controlling the fourth embodiment The flow in FIG. 20 is a replacement of steps 205 to 211 in FIG. 14. Those component parts common to the steps in FIG. 14 will not be described. First, if step 205 (FIG. 14) decides that the engine is in steady operating state, step 501 calculates a new learning compensation value of the injector by equation (15). Then, step 502 determines the intake air flow rate region $Q_{aj}$ of the map of the air flow sensor in FIG. 15. Step 503 reads out of the map the present learning compensation value $K_H$ for the intake air flow rate region $Q_{aj}$ determined at step 502, and a new learning compensation value is calculated from equation (16). The two compensation values thus calculated are updated on the map. Upon separate learning of the new learning compensation values, the fuel injection rate is determined by 212 and subsequent steps (FIG. 14).

The present invention is not confined to the plurality of embodiments described above illustratively, but it should be pointed out that various applications and modifications having the same effect as the above-mentioned embodiments are possible on the basis of the disclosure in this specification. The required fuel injection rate $T_i$, for example, may be determined more accurately by taking various compensation factors and engine condition parameters into account in addition to the factors include in the equations shown above.

We claim:

1. An engine control system for an internal combustion engine having fuel injection means for injecting fuel, a processor for controlling said engine control system and a memory for storing data, comprising:

means for detecting intake air flow in the engine;

means for detecting engine speed;

means for detecting oxygen concentration of exhaust gas of the engine; said processor including first calculation means for calculating an error between an actual air-fuel ratio and a previously determined target air-fuel ratio on the basis of detected oxygen concentration of the exhaust gas;

first determining means for determining a first compensation factor for compensating for changes in input/output characteristics of said intake air flow amount detecting means;

second determining means for determining a second compensation factor for compensating for changes in input/output characteristics of said fuel injection means;

second calculating means for calculating a basic fuel injection amount from the first compensation factor, the engine speed and the intake air flow;

third calculating means for calculating a required fuel injection amount for reducing an error of the air-fuel ratio using the basic fuel injection amount, the second compensation factor and the air-fuel ratio error;

generating means for generating a drive signal indicating a required fuel flow rate; and means for controlling said fuel injection means to inject fuel into the intake manifold of the engine in response to the drive signal indicating the required fuel flow rate.

2. An engine control system according to claim 1, wherein said first determining means for determining the first compensation factor includes dividing means for dividing the air-fuel ratio error calculated by said first calculating means in a predetermined ratio into first and second portions and means for determining the first compensation factor on the basis of one of said first and second portions, said second determining means for determining the second compensation factor includes means for determining the second compensation factor on the basis of the other of said first and second portions, and said dividing means includes means for determining the predetermined ratio according to a value of the intake air flow on the basis of a relationship between the determined ratio and the intake air flow.

3. An engine control system according to claim 1, wherein said first determining means for determining the first compensation factor includes dividing means for dividing the air-fuel ratio error calculated by said first calculating means in a predetermined ratio into said first and second portions and means for determining the first compensation factor on the basis of one of said first and second portions, said second determining means for determining the second compensation factor includes means for determining the second compensation factor on the basis of the other of said first and second portions, and said dividing means includes means for determining the predetermined ratio in accordance with a value of engine load on the basis of a relationship between the predetermined ratio and the engine load and means for calculating a value representing the engine load from the intake air flow and the engine speed.

4. An engine control system according to claim 2 or 3, further comprising means for determining an ignition timing of the engine on the basis of the basic fuel injection amount calculated by said second calculating means and the engine speed.

5. An engine control system according to claim 1, further comprising third determining means for determining whether the intake air flow belongs to a predetermined air flow rate region, and means for instructing the second determining means to learn the input/output characteristics of the fuel injection means when the intake flow belongs to the predetermined air flow rate region and instructing the first determining means to learn the input/output characteristics of the intake air flow detection means when the intake air flow does not belong to said predetermined air flow rate region.

6. An engine control system according to claim 5, wherein the predetermined air flow rate region is set in a specified air flow rate region where the input/output characteristics of the intake air flow detection means remain substantially unchanged.

7. An engine control system according to claim 5, further comprising means for counting a number of occurrences a predetermined operating condition of the engine, and indicating means for indicating when said counting means has reached a predetermined count value, said third determining means operating in response to the indication of a predetermined count value by said indicating means.

8. An engine control system according to claim 2 or 3, wherein said first determining means for determining the first compensation factor includes first writable memory means for storing a value of the first compensation factor corresponding to each of a plurality of regions into which intake air flow rate is divided, said second determining means for determining the second compensation factor includes second writable memory means for storing a value of the second compensation factor, and further including learning means for rewriting the values of the compensation factors stored in the first and second memory means to store new values of compensation factors upon determining the first and second compensation factors.

9. An engine control system according to claim 2 or 3, wherein said means first determining means for determining the first compensation factor includes first writable memory means for storing a value of the first compensation factors corresponding to each of a plurality of regions into which intake air flow rate is divided, said second determining means for determining the second compensation factor includes second writable memory means for storing a value of the second compensation factor corresponding to each of a plurality of regions into which basic fuel injection amount is divided, and further including learning means for rewriting the value of the compensation factors stored in the first and second memory means to store new values of compensation factors respectively upon determination of the first and second compensation factors.

10. An engine control system according to claim 2 or 3, wherein said first determining means for determining the first compensation factor includes first writable memory means for storing a value of the first compensation factor corresponding to each of a plurality of regions into which an operating area designated by intake air flow rate and engine speed is divided, said second determining means for determining the second compensation factor includes second writable memory means for storing a value of the second compensation factor, and further including learning means for rewriting the value of the compensation factors stored in the first and second memory means as new compensation factors, respectively, upon determination of the first and second compensation factors by said first and second determining means.

11. A method of controlling fuel injection in an internal combustion engine by an engine control system which determines a target air-fuel ratio for controlling said internal combustion engine, said method comprising the steps of:

(a) detecting intake air flow amount and engine speed;

(b) detecting oxygen concentration of exhaust gas of the engine to determine an actual air-fuel ratio;

(c) determining an air-fuel ratio error between the actual air-fuel ratio and said target air-fuel ratio;

(d) storing in a memory secular information indicating changes in input/output characteristics of an air flow amount detector and fuel injectors of the engine;

(e) determining a first compensation factor for compensating for changes in input/output characteristics of said air flow amount detected using said secular information stored in said memory and said air-fuel ratio error;

(f) determining a second compensation factor for compensating for changes in input/output characteristics of said fuel injectors using said secular information stored in memory and said air-fuel ratio error;

(g) calculating a basic fuel injection amount using said first compensation factor, detected engine speed and detected intake air flow amount;

(h) calculating a required fuel injection amount for reducing an error in the air-fuel using the basic fuel injection amount, the second compensation factor and the air-fuel ratio error; and (i) generating a drive signal indicating said required fuel injection amount and applying said drive signal to said fuel injectors.

12. A method according to claim 11, wherein said secular information stored in memory comprises a plurality of distribution ratios accessed in accordance with engine load, and wherein said first compensation factor is determined in step (e) by multiplying said air-fuel ratio error and a distribution ratio obtained from memory on the basis of current engine load, and said second compensation factor is determined in step (f) by multiplying said air-fuel ratio error and the compliment of said distribution ratio obtained from memory on the basis of current engine load.

13. A method according to claim 12, wherein said plurality of distribution ratios are stored in memory according to respective values of basic fuel injection rate.

14. A method according to claim 12, wherein said plurality of distribution ratios are stored in memory according to respective values of intake air flow amount.

15. A method according to claim 11, further comprising the steps of:

(j) determining an ignition timing of the engine on the basis of said basic fuel injection amount and detected engine speed.

16. A method according to claim 11, further comprising the steps of:

(k) storing in memory values of said first and second compensation factors on the basis of at least respective values of intake air flow amount; and (l) updating the values of said first and second compensation factors stored in memory according to the values of said compensation factors determined in steps (e) and (f).

17. A method according to claim 16, further comprising the steps of:

(m) detecting whether the intake air flow amount falls within a predetermined air flow rate region; and wherein said step (l) comprises:

(11) updating the values of said second compensation factor stored in memory only when said intake air flow amount falls within said predetermined air flow rate region; and

(12) updating the values of said first compensation factor when said intake air flow amount falls outside of said predetermined air flow rate region.

18. A method according to claim 17, wherein said predetermined air flow rate region is set in a region where the input/output characteristics of the air flow amount detector remains substantially unchanged.

19. A method according to claim 17, further comprising the steps of:

(n) counting a number of occurrences of a predetermined operation condition of the engine; and (o) indicating when the counting in step (n) reaches a predetermined count value;

wherein said step (m) is performed only after said counting has reached a predetermined count value.

20. A method according to claim 19, wherein said predetermined operation condition of the engine is engine starting.

* * * * *